US005943967A

United States Patent [19]

Sherman

[11] Patent Number: 5,943,967

[45] Date of Patent: Aug. 31, 1999

[54] MOBILE PHARMACY SHELVING

[75] Inventor: Philip D. Sherman, Mokena, Ill.

[73] Assignee: Morgan Marshall Industries, Inc., Chicago Heights, Ill.

[21] Appl. No.: 08/970,935

[22] Filed: Nov. 14, 1997

[51] Int. Cl.[6] ..... A47B 11/00

[52] U.S. Cl. ..... 108/102

[58] Field of Search ..... 100/102, 137, 100/143; 312/198, 199, 201; 211/162, 151; 105/198.3

[56] References Cited

U.S. PATENT DOCUMENTS

| | | | |
|---|---|---|---|
| 2,166,704 | 7/1939 | Foulkes | 312/199 |
| 3,080,204 | 3/1963 | Lindhgren | 312/199 |
| 3,397,652 | 8/1968 | Cardwell . | |
| 3,489,295 | 1/1970 | Hartel . | |
| 3,640,595 | 2/1972 | Staller et al. | 312/199 X |
| 3,724,389 | 4/1973 | Greaves | 312/199 X |
| 3,829,189 | 8/1974 | Staller | 312/200 X |
| 4,119,376 | 10/1978 | Moyer | 312/200 X |
| 4,557,534 | 12/1985 | Dahnert | 312/198 X |
| 5,072,838 | 12/1991 | Price, Jr. et al. | 312/198 X |
| 5,205,627 | 4/1993 | Davison et al. | 312/198 X |
| 5,226,549 | 7/1993 | Price, Jr. et al. | 211/162 |

*Primary Examiner*—Jose V. Chen
*Attorney, Agent, or Firm*—Lee, Mann, Smith McWilliams, Sweeney & Ohlson

[57] ABSTRACT

A pharmacy shelving array is described which has a plurality of side-by-side, open-faced fixed shelving columns and a plurality of side-by-side, track mounted, roller supported movable shelving units parallel to and closely adjacent to the fixed columns. Tracks lying parallel to the front faces of the open-faced fixed shelving columns and having end stops adjacent their ends are provided. Each movable shelving unit has a back, an open front, sides, a top and a bottom, and a plurality of shelves extending between the sides. A guide adjacent the top and parallel to the track is provided for stabilizing the movable shelving units against tipping. A self-priming deceleration system is provided adjacent the side of each movable shelving unit for engaging a next adjacent shelving unit or end stop for slowing movement of the movable shelving unit as it moves in the direction thereof along the track.

4 Claims, 3 Drawing Sheets

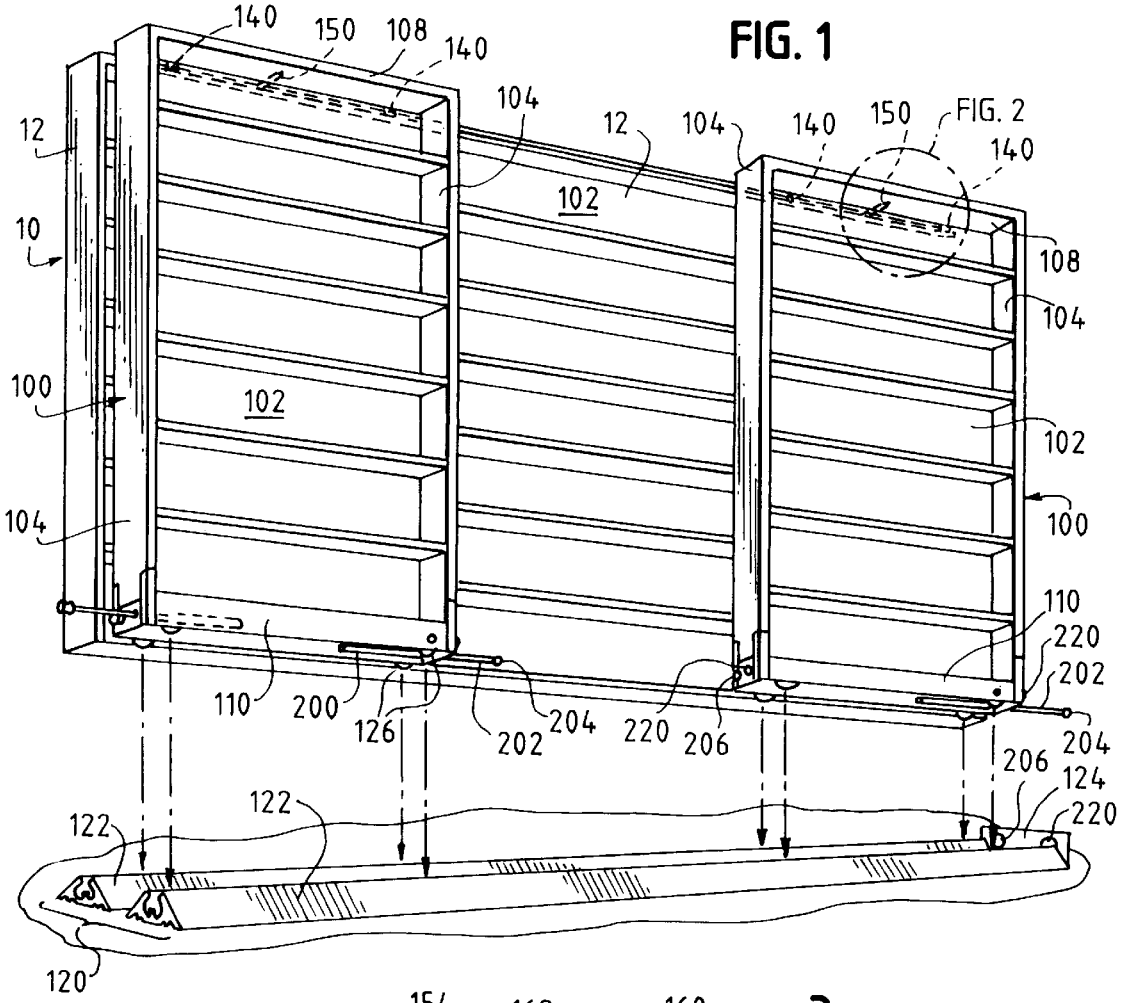
FIG. 1
140
150
108
140
104
12
10
100
102
104
12
104
140
150
FIG. 2
140
108
104
102
100
110
220
202
204
206
124
220
110
200
126
202
204
220
206
122
122
120
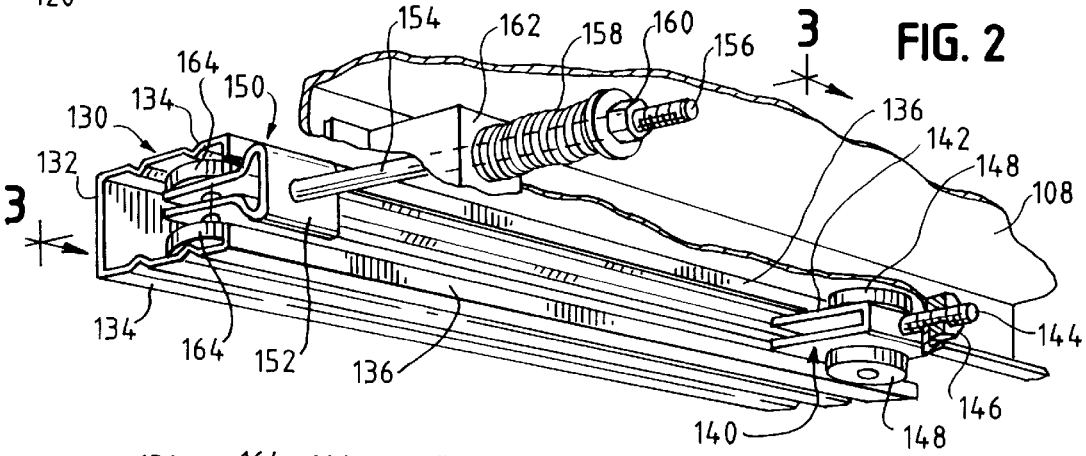
FIG. 2
3
3
154
162
158
160
156
164
150
134
130
132
136
142
148
108
134
164
152
136
144
146
140
148
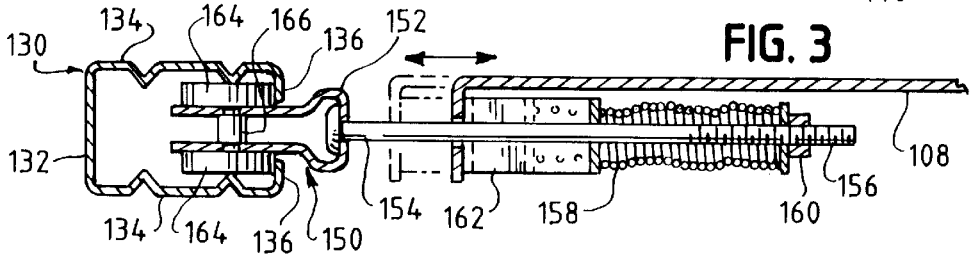
FIG. 3
134
164
166
136
152
130
132
108
156
160
154
162
158
134
164
136
150

MOBILE PHARMACY SHELVING

BACKGROUND OF THE INVENTION

Pharmacies typically stock thousands of pharmaceuticals for selection and use in dispensing prescriptions. These are typically in small vials or bottles which must be maintained in desired predetermined arrays and arrangements, and must be readily accessible. Because there are so many which must be kept in predetermined arrays, shelving to house and store them must be available. Again, because there are so many pharmaceuticals to stock, the linear shelf space required is very substantial.

Because storage space internally of a store in which a pharmacy is located is typically limited and expensive, the provision of open shelving which is accessible throughout to pharmacists requires more space and more physical movement and travel by pharmacists than is optimal. For that reason, shelving arrays which employ movable units are attractive alternatives to full-open fixed shelving. However, movable shelving modules which bear large numbers of objects, such as pharmaceuticals, which easily shift and fall if jolted or jostled must be stable and solid and must minimize the possibility of overturning and shifting the objects stored on the movable modules.

It would be desirable to provide a compact pharmacy shelving array employing movable modules which minimizes shifting and disturbances of objects stored thereon, while providing ready access to rear modules temporarily blocked from access by movable modules disposed in front of the rear modules.

SUMMARY OF THE INVENTION

In accordance with the present invention, an improved modular pharmacy shelving array is provided which has rear modules and which also has movable front modules which may be moved and shifted relative to the rear modules without deleteriously shifting the shelving contents. Such a shelving array comprises a plurality of side-by-side, open-faced fixed shelving columns and a plurality of side-by-side, track mounted, roller supported movable shelving units parallel to and closely adjacent to the fixed columns, track means for guiding the roller supported shelving units, the track means lying parallel to the front faces of the open-faced fixed shelving columns and having end stops adjacent the ends of the track means, each track mounted movable shelving unit having a back, an open front, sides, a top and a bottom, and a plurality of shelves extending between the sides, guide means adjacent the top and parallel to the track means for stabilizing the movable shelving units against tipping, and self-priming deceleration means adjacent the top or bottom of each shelving unit for engaging a next adjacent shelving unit or end stop for slowing movement of a movable shelving unit as it moves in the direction thereof along the track means.

In a preferred form the top of each shelving unit mounts guides for engaging the guide means. The guide means comprises a guide rail, and the guides comprise a plurality of guide members rollingly engaging the guide rail for guiding the shelving unit as it moves along the tracks. Desirably, the guide rail provides guide flanges, the opposite sides of which are engaged by the guide members for guiding the shelving unit. At least one of the guide members has means for resiliently bearing against the guide flanges.

In a preferred form the deceleration means comprises a cylinder and piston, the piston being adapted to project well beyond the side of the shelving unit for engaging a next adjacent shelving unit or end stop. The cylinder and piston may be a pneumatic cylinder and piston.

In its most preferred form the piston terminates at its projecting end in a magnetic member and the next adjacent shelving unit or end stop provides a complementary confronting magnetic member for withdrawing the piston from the cylinder as a shelving unit moves away from a next adjacent shelving unit or end stop. Additionally, the side of a first shelving unit and the side of the next adjacent shelving unit or end stop each mount a rubber bumper, the bumpers being aligned, each with the other, whereby as the shelving units come into close proximity, the rubber bumpers engage.

The pharmacy shelving array of the present invention may comprise first and second pluralities of side-by-side track mounted, roller supported movable shelving units parallel to the fixed columns, the first plurality being closely adjacent to the fixed columns and the second plurality being closely adjacent to the first plurality, and wherein separate track means guide each of the pluralities of movable shelving units.

Further objects, features and advantages of the present invention will become apparent from the following description and drawings.

BRIEF DESCRIPTION OF THE DRAWINGS

FIG. 1 is a front perspective view, partially exploded, of a modular shelving array of the present invention;

FIG. 2 is a fragmentary enlarged perspective view of an encircled portion of the modular shelving array of FIG. 1;

FIG. 3 is a cross-sectional elevational view taken substantially along line 3—3 of FIG. 2;

DETAILED DESCRIPTION

Figure 4:
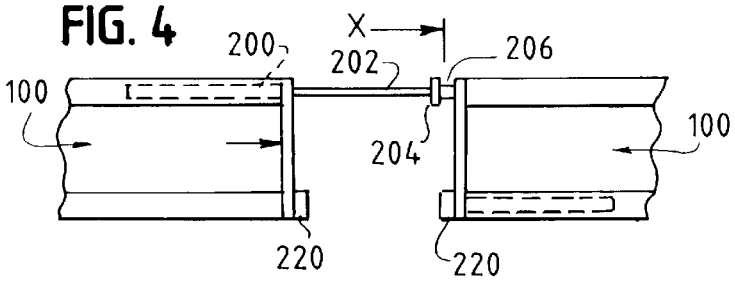
FIG. 4 is a fragmentary plan view of the deceleration system of the present invention as employed between an adjacent pair of movable shelving units.

Referring now to the drawings, a modular shelving array 10 of the present invention comprises a plurality of fixed side-by-side, open-faced shelving columns 12 and a plurality of open-faced, side-by-side movable shelving columns or units 100 which lie parallel to and closely adjacent to the fixed shelving columns 12. Units 100 each may be about four feet wide by seven feet high in front view and about ten inches in depth. Each unit 100 desirably comprises a back panel 102, opposite vertical sides 104, a top 108 and a bottom 110. Each is also provided with a plurality of conventional horizontal shelves 112 which are vertically spaced and which are mounted to be vertically adjustable as desired and in a conventional manner.

Figure 7:
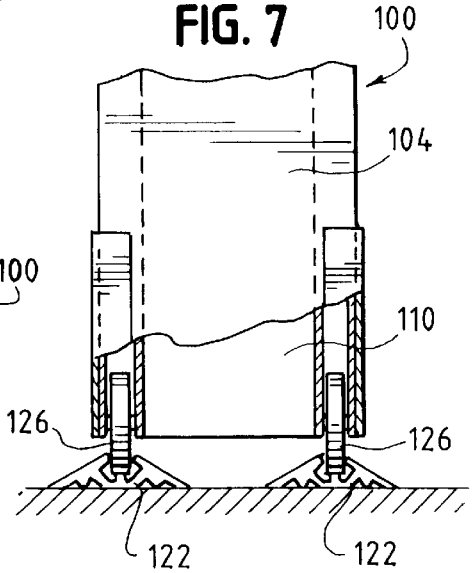
FIG. 7 is a fragmentary side elevational view of a movable shelving unit of FIG. 1.

Each movable shelving unit 100 is supported for rolling movement along a floor supported track system 120, such as along a pair of tracks 122 which lie parallel to the open front faces of the fixed columns. An end or stop plate 124 is provided adjacent each end of the track system 120. Each movable shelving unit 110 is provided with pairs of spaced rollers 126 which are adapted to roll along and be guided by the tracks 122 as is illustrated best in FIG. 7.

For stabilizing the movable shelving units 100 and to maintain them against tipping, an upper guide means or rail 130 is provided adjacent to the tops 108 of the shelving units. It is positioned above the shelving unit 100 and is disposed parallel to the tracks 122. The guide rail 130 is secured, as to a ceiling or to a wall.

In one form, the rail 130 comprises an open channel having a back wall 132, top and bottom side walls 134 and front flanges 136. Flanges 136 serve as guide surfaces for a plurality of guides mounted to a movable shelving unit 100.

A first guide 140 comprises a bracket 142 having a threaded pin 144 for securing the guide to the top 108 of the shelving unit 100. It may be secured thereto by a nut 146. Bracket 142 rotatably journals a pair of coaxially mounted guide rollers 148. Rollers 148 are positioned to rollingly engage, to bear against, and to be guided by the outer surfaces of flanges 136.

A second guide 150 comprises a bracket 152 mounted to a pin 154. Pin 154 is threaded at one end 156. Pin 154 is encircled by a compression spring 158 which is captured between a nut and washer 160 and a top 108 of the shelving unit, as via a sheet metal mounting bracket 162. Guide 150 also includes a pair of guide rollers 164 which are coaxially mounted on a shaft 166 and which are positioned to rollingly engage and bear resiliently against the inner surfaces of flanges 136.

Desirably, each movable shelving unit 100 has a pair of first guides 140 and one second guide 150, with a first guide 140 adjacent each of the sides 104 of the shelving unit 100 and a second resilient guide 150 intermediate the first guides 140. In that manner, the spring loaded second guide will tend to maintain the rollers 148, 164 in contact with the respective opposite outer and inner surfaces of the flanges 136 and will cause the upper end of the shelving unit to accommodate to any variations in the guide rail 130 and to forces applied to the movable shelving unit 100.

As will be apparent, each movable shelving unit 100 is movable along its track system 120, along tracks 122 and guide rail 130, and will eventually come into contact, either with the stops 124 at the ends of a series of adjacent movable shelving units 100 mounted on a track system 120 or with an adjacent shelving unit 100. To minimize or substantially eliminate displacement of bottles and other containers and objects on the shelves 112, a self-priming deceleration and shock absorbing system is provided for slowing movement of a shelving unit as it moves in the direction of a next adjacent shelving unit or end stop and comes into engagement with the next adjacent unit.

The deceleration and shock absorbing system is preferably self-priming and includes a cylinder 200, such as a pneumatic cylinder, from which a cylinder rod or piston 202 extending outwardly and projecting well beyond the side 104 of one shelving unit towards the next adjacent shelving unit for engaging the next adjacent shelving unit 100 or an adjacent end stop 124. To assure the operation of the cylinder 200, the end of the piston 202 is adapted to magnetically couple with the next adjacent shelving unit. To that end, either the end 204 of the piston 202 is a magnet or is magnetic and a confronting member 206 on the adjacent unit is a magnet or a complementary magnetic material. Thus, when adjacent shelving units come into close adjacency, the rod 202 is substantially entirely within the associated cylinder 200 and the end 204 and member 206 are in magnetic engagement.

As the adjacent shelving units 100 are spread apart, the magnetic attraction between the end 204 and member 206 causes the piston to be withdrawn from the cylinder 200 (a self-priming function) until it has been fully extended. Thereafter, the magnetic engagement will be broken. When next the two adjacent shelving units are moved towards each other, the rod end 204 will eventually engage the member 206 and further movement of the shelving units towards each other will be resisted and slowed by the pneumatic cylinder 200. Although the force of the cylinder will not be sufficient to prevent closing of the shelving units 100 against each other, the cylinder 200 will tend to decelerate movement of one unit 100 as it moves towards the other and will resist too rapid closing.

In addition to the cylinder and piston 200, 202, adjacent sides 104 of the shelving units mount aligned bumpers, such as rubber bumpers 220 which, if and when they engage, will cushion any shock loads which may result from their engagement as a pair of shelving units come into engagement.

To minimize shock loads when the end shelving units in an array move outwardly into contact with the end stops 124, each of the shelving units and adjacent stops are outfitted as are adjacent pairs of movable shelving units. To that end, the outer side 104 of a shelving unit 100 mounts a cylinder 200 having a piston 202, the end 204 of which piston confronts a member 206 associated with the stop 124. They function as those members function in a confronting pair of movable shelving units and as described above. Similarly, rubber bumpers 220, one on the movable shelving unit and one on an adjacent stop 124, confront each other and function as do the pairs of rubber bumpers described above on a pair of adjacent movable shelving units.

Figure 8:
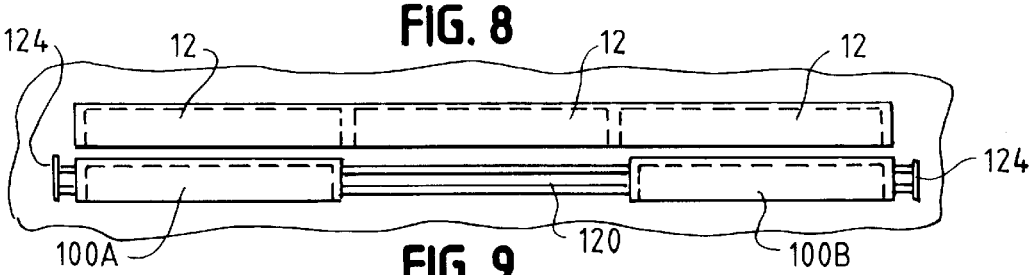
FIG. 8 is an overall plan view of a shelving array with the movable units shown in a first position.
Figure 9:
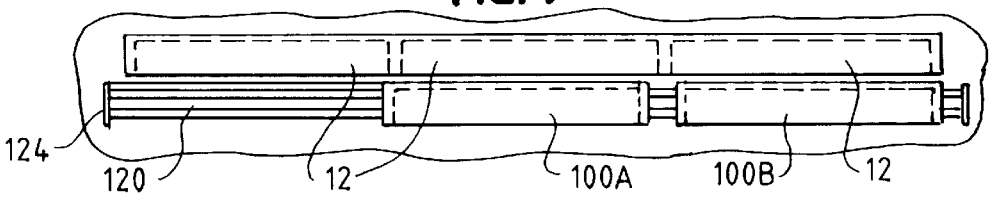
FIG. 9 is an overall plan view like FIG. 8, but with the movable units shown in a second position.
Figure 10:
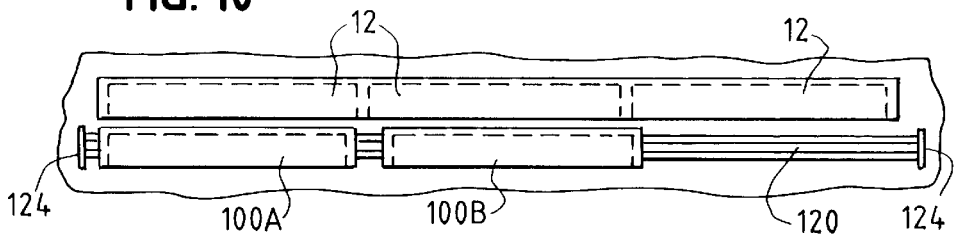
FIG. 10 is an overall plan view like FIG. 8, but with the movable units shown in a third position.

As will now be apparent, and as illustrated by FIGS. 8,9 and 10, shelving arrays in accordance with the present invention may comprise a plurality of fixed columns of shelving such as fixed columns 12. They may be associated with a plurality of closely confronting movable shelving units, such as movable shelving units 100A and 100B. Shelving units 100A and 100B are mounted on a floor mounted track system 120 and may be moved so that access may be obtained, when desired, to the front of each of the fixed columns 12.

Figure 5:
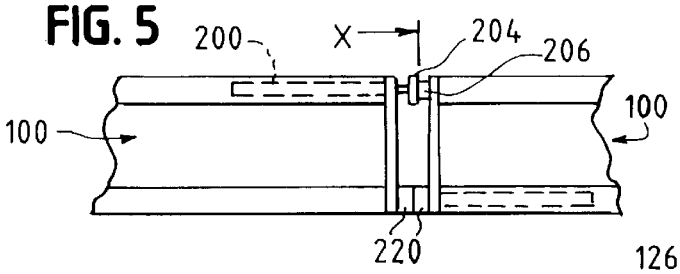
FIG. 5 is a view like FIG. 4, but of the adjacent pair of movable shelving units in a closed position.
Figure 6:
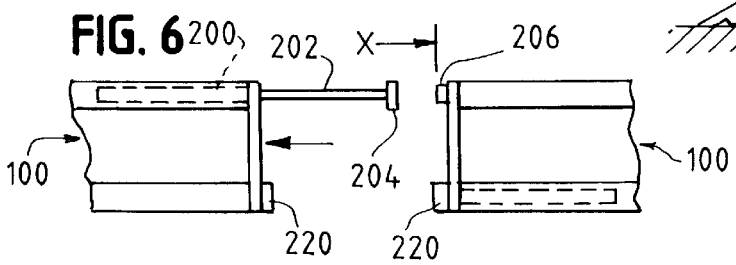
FIG. 6 is a view like FIG. 4, but of the adjacent pair of movable shelving units moved to a position in which the deceleration system is not in use.

As seen in FIG. 8, a column 12 is accessible from between shelving units 100A and 100B. From that array, to gain access to a column 12, shelving unit 100A may be moved to the position shown in FIG. 9. It will be apparent from the foregoing that as shelving unit 100A approaches shelving unit 100B, it will move gradually from the position represented by FIG. 6 to that represented by FIG. 4, and finally to the position represented by FIG. 5, with the shelving unit 100A being decelerated in its movement by the cylinder and piston 200, 202 and will be cushioned by bumpers 220 as unit 100A moves to the position of FIG. 5.

Similarly, when units 100A and 100B are together moved, as from the position of FIG. 9 to that of FIG. 10 (or they can be moved separately), the cylinder 200 and piston 202 on the outside of unit 100A and the associated bumper 220 will cooperate with the stop 124 as has been described to minimize possible shifting, tumbling or toppling of the objects supported on the shelves of shelving units 100A and 100B.

Figure 4A:
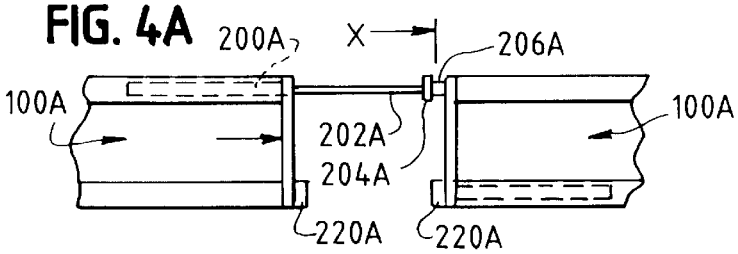
FIG. 4A is a fragmentary plan view of a deceleration system of the present invention as employed between an adjacent pair of movable shelving units, but located adjacent the tops of the shelving units.

FIG. 4A is a view like that of FIG. 4, except that the deceleration and shock absorbing system which includes a pneumatic cylinder 200A is positioned at the top of a shelving unit 100A rather than at the bottom as described above. Similarly, the piston 202A, its end 204A and member 206A, as well as rubber bumpers 220A, are located at the tops of shelving units 100A as are associated stops which function with piston ends 204A in the same manner they are described above as functioning with piston ends 204.

Figure 12:
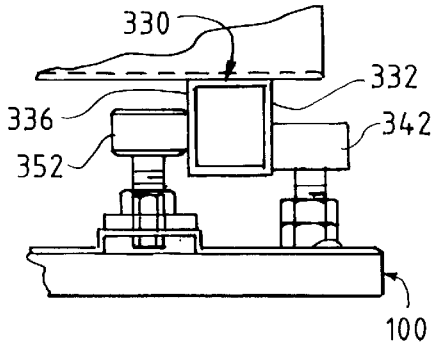
FIG. 12 is a fragmentary side elevational view of an alternative guide rail system for stabilizing shelving units against tipping.
Figure 13:
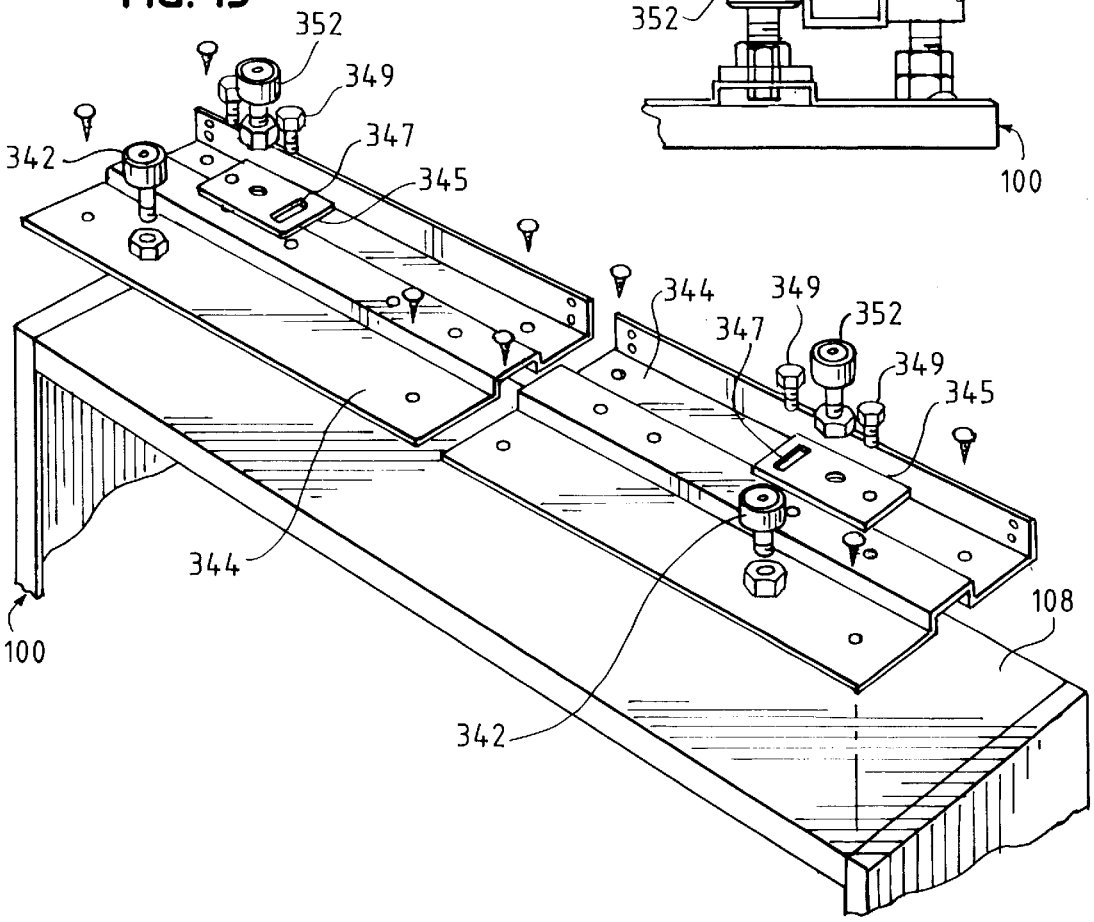
FIG. 13 is a fragmentary exploded perspective view of FIG. 12.

An alternative system for stabilizing movable shelving units 100 and maintaining them against tipping is shown in FIGS. 12 and 13. As there shown, an upper guide means or rail 330 is provided adjacent to the tops 108 of the shelving units 100, which units may be otherwise the same as described above. Rail 330 is positioned above the shelving unit 100, is disposed parallel to the support tracks, and is secured, as to a ceiling, to a wall or other support structure.

In one form, the rail 330 comprises a hollow rectangular tube having a back wall 332 and a front wall 336. Walls 332 and 336 serve as guide surfaces for a plurality of guides mounted to the movable shelving unit 100.

Each back guide, of which there is a spaced apart pair, comprises a roller bearing 342 secured to a support plate 344 secured to the top 108 of the shelving unit 100 as by threaded fasteners. Roller bearings 342 are positioned to rollingly engage, to bear against, and to be guided by the back wall 332 of rail 330.

Each front guide, of which there is a spaced apart pair, comprises a roller bearing 352 secured to support plate 344 by an intermediate adjustment plate 345. Plate 345 is secured by threaded bolts 349 and allows adjustment via a slot 347 so that roller bearings 352 may be pivoted toward and away from the front wall of guide rail 330. In that manner, the pairs of roller bearings 342, 352 may be adjusted so that they suitably guide the shelving unit as it moves along rail 330 so that it may accommodate to any variations in the guide rail and to forces applied to the movable shelving unit 100.

Figure 11:
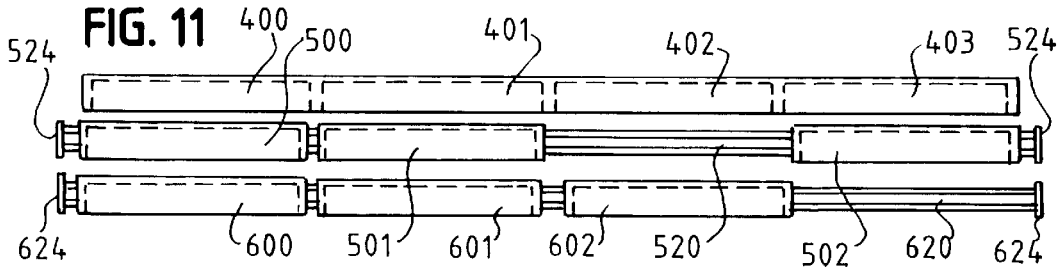
FIG. 11 is an overall plan view of a three deep shelving array, with two rows of movable shelving units shown in first positions.

It will also be apparent, as represented by FIGS. 10 and 11, that the tracks may support, one, two (as shown in FIG. 10), or three (as shown in FIG. 11) or more shelving units 100, typically with the number of movable shelving units 100 on a common track 120 being one less in number than the corresponding fixed columns in the shelving array.

Additionally, more than one array of movable shelving units may be used, as is illustrated by FIG. 11. FIG. 11 shows one fixed shelving array of four columns 400, 401, 402, 403 and two arrays of three movable shelving units, each having a plurality of movable shelving units (500, 501, 502; and 600, 601, 602), and each a plurality desirably having one less unit than the number of associated fixed shelving columns. Again, each movable unit is desirably track and rail supported and stabilized as on tracks 520, 620, respectively, and is outfitted to provide for deceleration and cushioning of the units as described above as they close against each other or an adjacent stop 524, 624, respectively, thereby to minimize dislocation of objects supported on the shelving as has been described.

In each case, the fixed and movable arrays provide maximum storage capacity in a minimum space, while providing rapid access to all stored items.

It will be apparent to those skilled in the art that further modifications in the embodiment may be made without departing from the spirit and scope of the invention. Accordingly, we do not intend the invention to be limited except as may be made necessary by the appended claims.

What is claimed is:

1. A pharmacy shelving array comprising a plurality of side-by-side open-faced fixed shelving columns and a plurality of side-by-side, track mounted, roller supported movable shelving units parallel to and closely adjacent to said fixed columns;

track means for guiding said roller supported shelving units, said track means lying parallel to the front faces of said open-faced fixed shelving columns and having end stops adjacent the ends of said track means;

each said track mounted movable shelving unit having a back, and open front, sides, a top and a bottom, and a plurality of shelves extending between said sides;

guide means adjacent said top and parallel to said track means for stabilizing the movable shelving units against tipping; and a self-priming deceleration means comprising a cylinder and piston adjacent the side of each shelving unit for engaging a next adjacent shelving unit or end stop for slowing movement of a said movable shelving unit as it moves in the direction thereof along said track means, said piston being adapted to project well beyond the side of said shelving unit for engaging a next adjacent shelving unit or end stop, and wherein said piston terminates at its projecting end in a magnetic member and said next adjacent shelving unit or end stop provides a complementary confronting magnetic member for withdrawing said piston from said cylinder as a said shelving unit moves away from a next adjacent shelving unit or end stop.

2. A pharmacy shelving array in accordance with claim 1, and wherein the side of a first shelving unit and the side of the next adjacent shelving unit or end stop each mount a rubber bumper, said bumper being aligned each with the other, whereby as said shelving units come into close proximity, the rubber bumpers engage.

3. A pharmacy shelving array comprising a plurality of side-by-side, open-faced fixed shelving columns and a plurality of side-by-side, track mounted, roller supported movable shelving units parallel to and closely adjacent to said fixed columns;

track means for guiding said roller supported shelving units, said track means lying parallel to the front faces of said open-faced fixed shelving columns and having end stops adjacent the ends of said track means;

each said track mounted movable shelving unit having a back, an open front, sides, a top and a bottom, and a plurality of shelves extending between said sides;

guide means adjacent said top and parallel to said track means for stabilizing the movable shelving units against tipping;

guides mounted at the top of each said shelving unit for engaging said guide means; and self-priming deceleration means adjacent the side of each shelving unit for engaging a next adjacent shelving unit or end stop for slowing movement of a said movable shelving unit as it moves in the direction thereof along said track means, said deceleration means comprising a cylinder and piston, said piston being adapted to project well beyond the side of said shelving unit for engaging a next adjacent shelving unit or end stop, and wherein said piston terminates at its projecting end in a magnetic member and said next adjacent shelving unit or end stop provides a complementary confronting magnetic member for withdrawing said piston from said cylinder as a said shelving unit moves away from a next adjacent shelving unit or end stop.

4. A pharmacy shelving array in accordance with claim 3, and wherein the side of a first shelving unit and the side of the next adjacent shelving unit or end stop each mount a rubber bumper, said bumper being aligned each with the other, whereby as said shelving units come into close proximity, the rubber bumpers engage.

* * * * *